United States Patent [19]

Cox

[11] 4,181,218

[45] Jan. 1, 1980

[54] PRE-MOIST TISSUE DISPENSING CONTAINER

[75] Inventor: Raymond W. Cox, Grays Point, Australia

[73] Assignee: Johnson & Johnson Baby Products Company, New Brunswick, N.J.

[21] Appl. No.: 879,831

[22] Filed: Feb. 21, 1978

[51] Int. Cl.[2] ..... B65D 85/67

[52] U.S. Cl. ..... 206/205; 206/409; 206/812; 220/253; 221/63; 242/55.54

[58] Field of Search ..... 221/63; 242/55.53, 55.54; 206/390, 407, 409, 389, 205, 812; 225/44, 45, 39, 106; 220/253, 8; 222/553

[56] References Cited

U.S. PATENT DOCUMENTS

| | | | |
|---|---|---|---|
| 1,729,432 | 9/1929 | Anderson | 225/44 X |
| 2,073,719 | 3/1937 | Ross | 242/55.53 |
| 2,328,246 | 8/1943 | Albion | 220/253 X |
| 3,207,390 | 9/1965 | Short | 222/553 |
| 3,472,364 | 10/1969 | Sloan | 242/55.53 X |
| 3,973,695 | 8/1976 | Ames | 221/63 |
| 4,017,002 | 4/1977 | Doyle et al. | 221/63 |

*Primary Examiner*—Francis J. Bartuska
*Attorney, Agent, or Firm*—Steven P. Berman

[57] ABSTRACT

A dispensing container for dispensing premoistened tissues sequentially is moulded as a base and a cap which are snap fitted together, the cap being rotatable on the base to bring into alignment respective apertures in the cap and base side wall in an open position whereby a tissue can be extracted and the cap being rotatable to a closed position in which the apertures are not aligned; the side walls of the container provide the respective apertures in frusto conical wall portions which are urged into contact by interengaging elements on the cap and base permitting relative rotation but opposing relative displacement in the axial direction at least in the closed position.

1 Claim, 20 Drawing Figures

12
12b
12a
12c
13
12d 12
12b
12a
12c
13
12d 12
12b
12a
12c
12d
13

10a
10

11
11a
14
13

12
12a
12b
12c
12d
13

15b
15c
15d
16
XVII
10
10a
11
11a
11b
14

PRE-MOIST TISSUE DISPENSING CONTAINER

FIELD OF THE INVENTION

The present invention relates to a container for storing, and when desired, dispensing sheets of material from within the container. The present invention may be especially useful in embodiments in which tissue like materials impregnated with a suitable fluid are stored within the container but the present invention is not limited to such embodiments.

PRIOR ART

It has hitherto been proposed to package a roll of premoistened tissue material in a container which has a snap fitting top cap with a small aperture therein through which the leading end of the tissue is inserted before snap fitting the top cap. The leading end of the tissue is simply gripped and pulled out and severed from the leading end of the succeeding tissue when it has been pulled through the small aperture. A readily removable sealing cap can be provided for closing the container dispensing aperture between dispensing operations.

In this prior proposal, the dispensing aperture is at the top end of the generally cylindrical package and this may be considered to have an adverse effect on the neatness, stackability of the container and the ability of the container to be made in a form whereby not only can the contents be retained with reliability but also contamination of the contents can be avoided. In particular if the container is to include a moistening liquid, especially a volatile liquid, it is necessary with such prior art proposals to provide effectively a carefully constructed gasket arrangement for sealing the top cap for the end of the container and the small closure cap.

SUMMARY OF THE INVENTION

According to the present invention there is provided a container from which sheet material is adapted to be dispensed and comprising a hollow base having an end wall and a side wall the exterior of which includes a frusto conical portion, a hollow cap having an end wall and a side wall the interior of which includes a frusto conical portion corresponding to the frusto conical portion of the hollow base, the hollow cap being formed so as to fit over the hollow base with the respective frusto conical portions coming into engagement in an assembled position, the cap and the base having interengageable retention means for retaining the cap on the base, the cap being relatively rotatable about the common axis of the frusto conical portions, said frusto conical portions on the cap and base side walls having respective corresponding apertures therethrough, the cap and base being rotatable between a first dispensing position in which the apertures are aligned to permit extraction of a sheet of material from within the hollow base, and a second closed position in which the apertures are out of alignment thereby closing the containter with the frusto conical portions in contact with one another.

The present invention may provide a neat, compact, easily and economically mouldable container which can be reliable and easy to use as well as providing an effective container for resisting the loss of any liquid contents and contamination of contents.

Preferably, the respective frusto conical surfaces comprise a substantial surface area of the side walls and it is most preferable that the axial length of the frusto conical surfaces on the cap and base are about or more than half the axial length of the hollow base. In this way substantial surface area for sealing the container is available.

Various configurations may be employed for the retention means for holding the cap on the base member. In preferred embodiments of the invention, the retention means comprises lug means on the interior of the cap and the provision of a profile on the exterior of the hollow base providing an abutment surface extending around the hollow base for retaining the lug means therein.

For the purpose of ensuring firm contact between the frusto conical surfaces, the abutment surface is preferably provided on a shallow inclined ramp orientated so that on rotating the cap towards the closed position, the axial compressive forces increase to improve the sealing effect. The ramp could be provided on the underside of a helical rib or by the upper side wall of a groove in the exterior of the hollow base.

In one embodiment of the invention, the apertures in the cap and base are relatively large, for example oval shaped, so that at least one finger of an adult can be inserted through the apertures when aligned to extract a sheet of material from the interior of the hollow base.

However, in another embodiment which can be especially advantageous where tissue-like wiping elements are to be dispensed from a roll of separable elements, only a very small aperture is provided in the hollow base for alignment with the aperture in the cap so that the tissue is compressed through the small aperture thereby minimizing the possibility of loss of liquid from within the container or contamination of the contents. In this embodiment it is preferable, for the purpose of facilitating the insertion of a roll of tissues, to provide a larger aperture of finger size in the frusto conical surface at an offset location so that with the cap removed from the base, the leading end of the first wipe is inserted through the large aperture; a slot connects the large aperture with the small aperture so that the leading end of the wiper can be fed down into the small aperture and the cap can then be fitted. A depression is provided in the frusto conical surface of the base around the small aperture for accommodating the leading end of the wipe in a cavity defined between the depression and the frusto conical surface of the cap when the cap is in a closed position.

Other features and an advantage which may be found in or associated with various forms of the invention will become apparent from the following description.

BRIEF DESCRIPTION OF THE DRAWINGS

For illustrative purposes only, embodiments of the invention will now be described, by way of example, with reference to the accompanying drawings of which.

DETAILED DESCRIPTION OF THE EMBODIMENTS OF THE INVENTION

Referring first to FIGS. 1 to 8, the container comprises a moulded plastic base 10 and a moulded plastic cap 11 having frusto conical side wall portions 10*a* and 11*a* respectively, the cone angles of which are desirably the same so that substantial contact occurs between the side wall portions when the cap is fitted on the base.

The cap 11 fits over the base 10 to provide a closed container having top and bottom walls 10*b* and 11*b*, contact being established between the side wall portions 10*a* and 11*a*, with the cap and base being rotatable relative to each other about a common axis.

Figures 1, 2, 3:
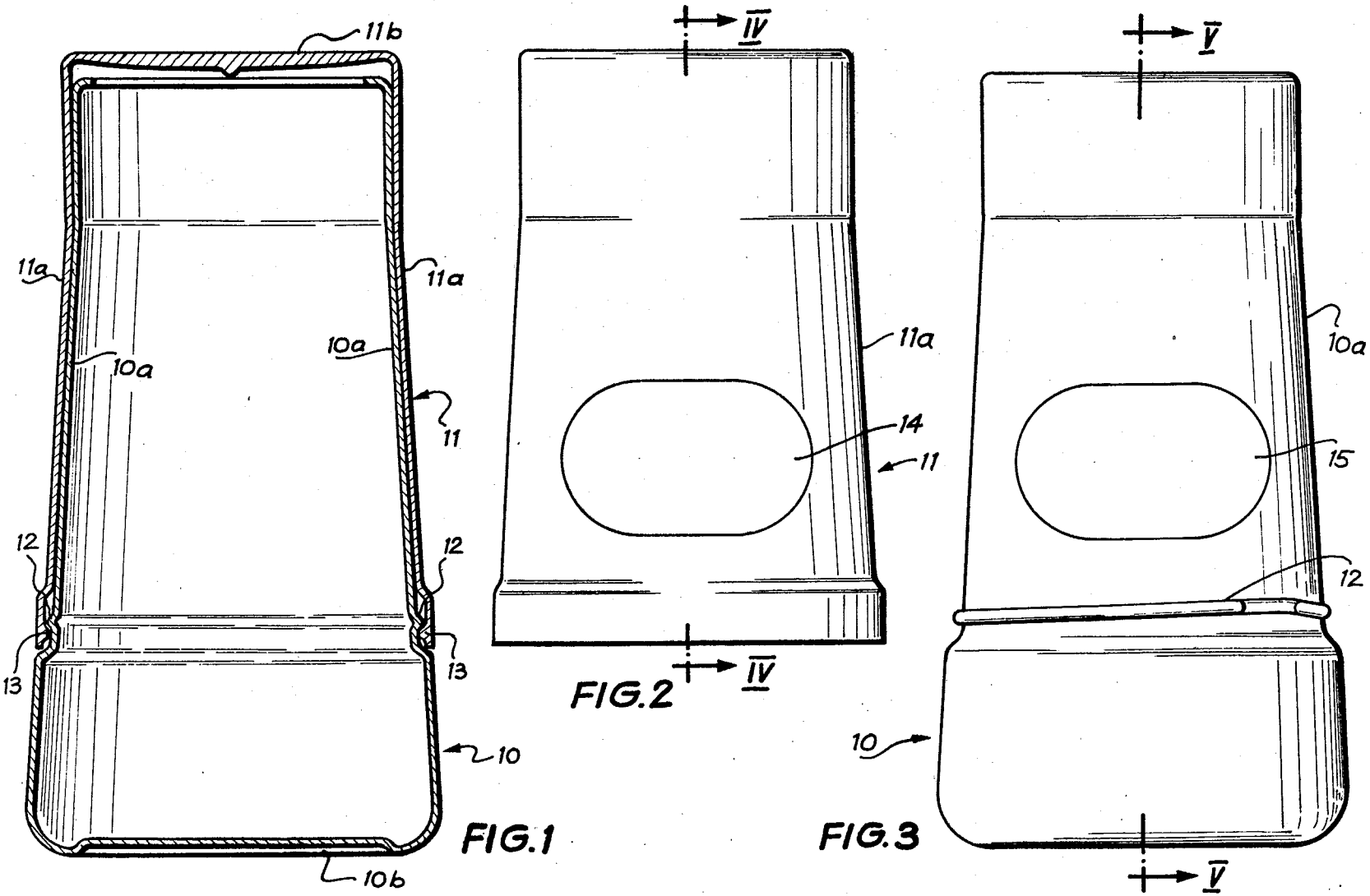
FIG. 1 is a side cross-sectional view of a dispensing container according to one embodiment of the invention.
FIG. 2 is a side view of a cap part of the container of FIG. 1.
FIG. 3 is a side view of a base part of the container of FIG. 1.

As best seen in FIGS. 2 and 3, similar oval shaped apertures 14 and 15 are provided in the frusto conical wall portions 11*a* and 10*a* of the cap and base respectively so that access to the interior of the container is possible with a finger when the apertures are aligned after appropriate rotation of the cap 11. The cap is rotatable from such an open position t a closed position at which the apertures are not aligned.

During rotation of the cap by manual effort, axial forces are applied naturally for urging the two frusto conical wall portions into engagement. These forces are greatly enhanced and positively ensured during closure by the provision of ramp in the form of a shallow inclined rib 12 extending around the base 10 and a cooperating projection or lug 13 on each side of the cap. The thread 12 is formed externally at the bottom of the frusto conical wall portion 10*a* of the base and the lugs 13 projects inwardly from the frusto conical wall portion 11*a* of the cap to engage below the rib 12.

Figures 4, 5, 6, 7, 8:
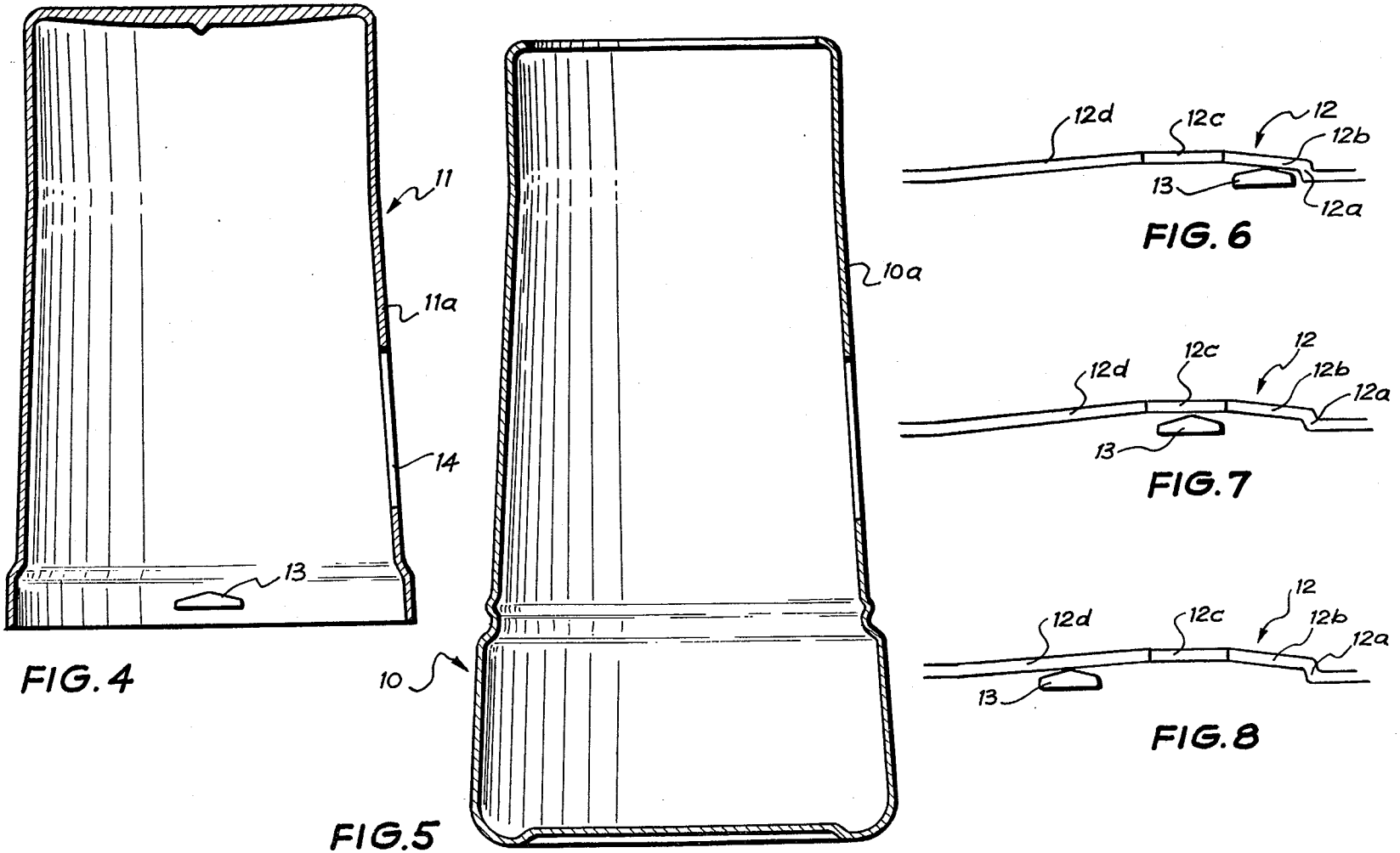
FIG. 4 is a section taken along the line IV—IV of FIG. 2.
FIG. 5 is a section taken along the line V—V of FIG. 3.
FIG. 6 is an elevation showing only certain parts of the cap and base when the container is in an open position.
FIG. 7 is a view similar to FIG. 6, showing the parts when the container is partly opened.
FIG. 8 is a view similar to FIG. 6 showing the parts when the container is closed.
Figure 11:
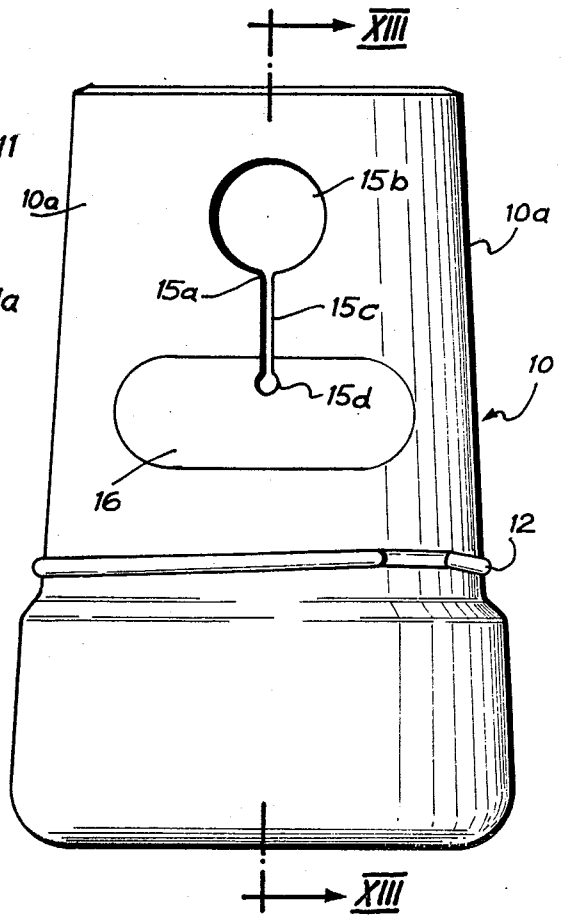
FIGS. 9 to 16 are views corresponding to FIGS. 1 to 8 respectively of another embodiment of the invention.
Figure 10:
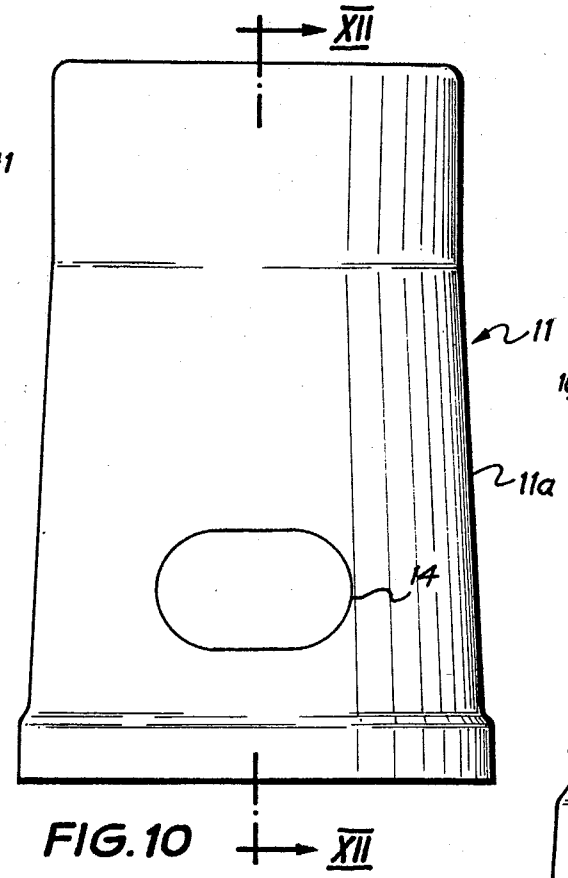
Figure 9:
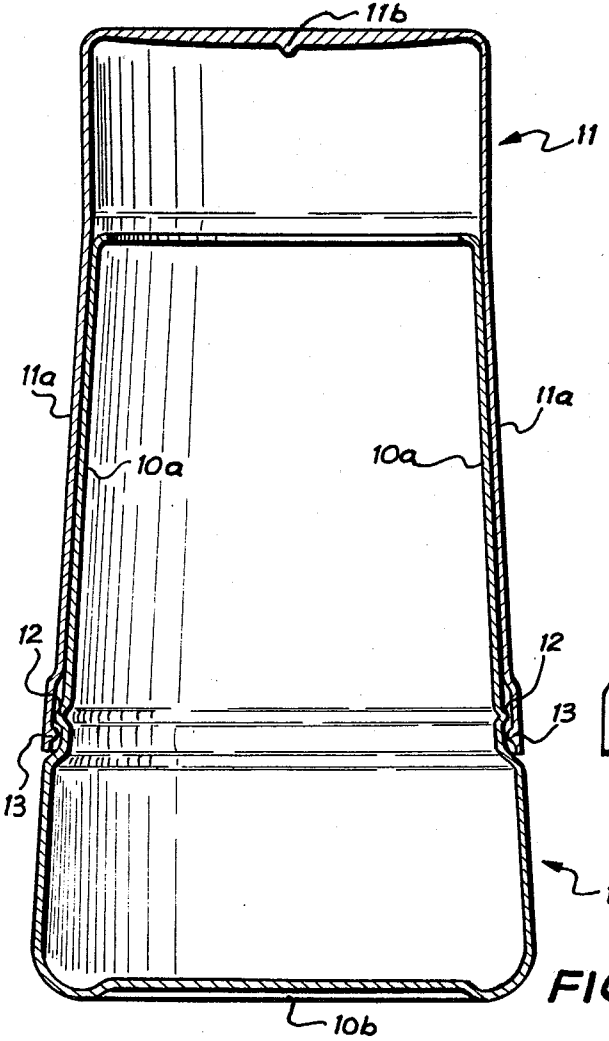
Figures 12, 13, 14, 15, 16:
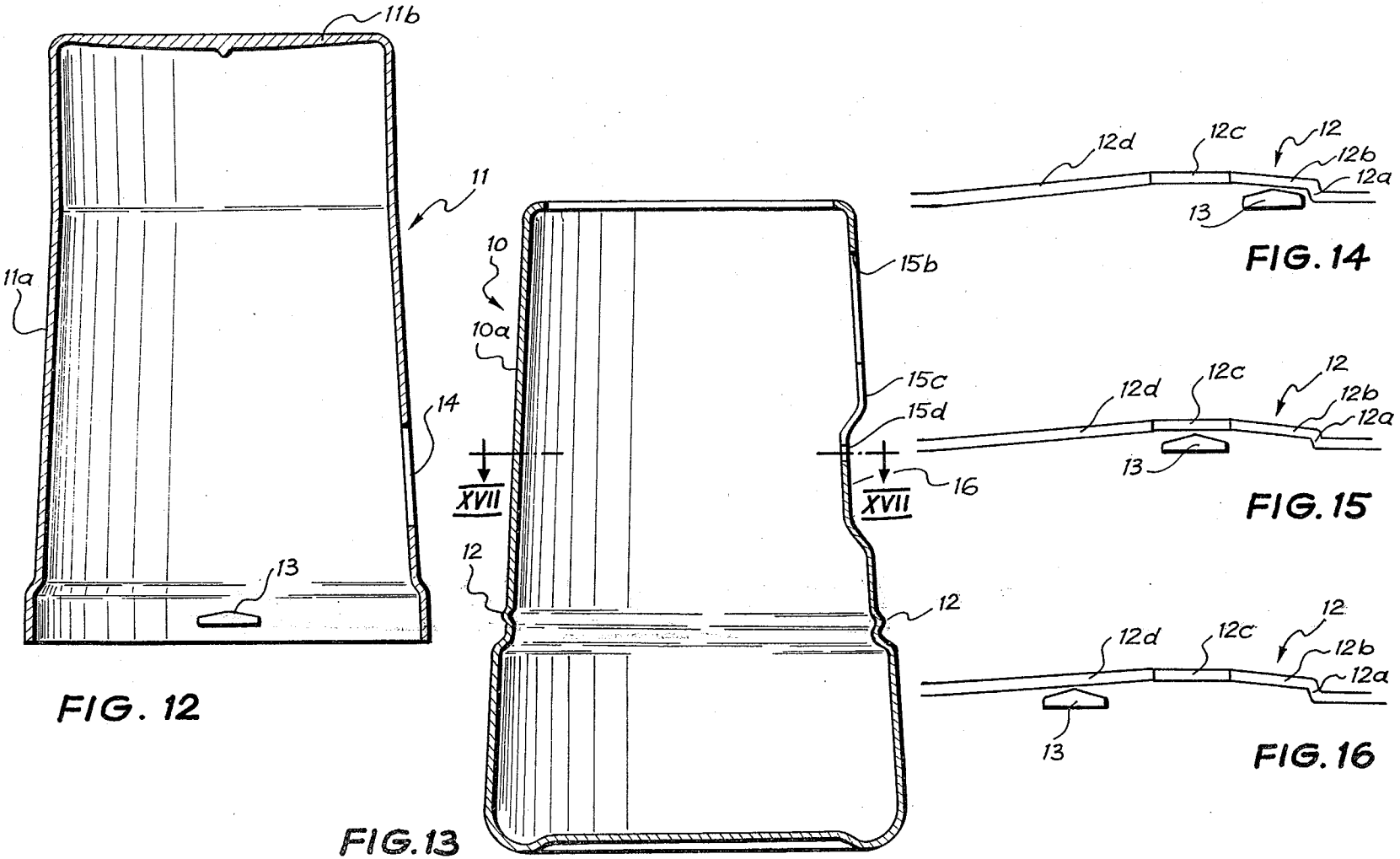

FIGS. 6 to 8 illustrate in schematic enlarged elevation the relative positions of the rib 12 and a lug 13 respectively in the open, part open and closed position of the container. In the fully open position of FIG. 6, an end of the lug 13 engages a shoulder 12*a* formed in the rib, which limits rotation of the cap beyond this open position, and an upper face of the lug engages firmly with a first ramp portion 12*b* of the rib 12 to pull the cap firmly into engagement on the base.

In the part open position of FIG. 7, the lug 13 is under a horizontal portion 12*c* of the rib and the cap retaining forces are at a minimum in this position. When the cap is rotated to the closed position of FIG. 8 the lefthand shallow shoulder on the upper surface of lug 13 engages a second ramp portion 12*d*, which follows a downward helical path such that the axial compressive forces increase as the cap is rotated. This ensures a state of static tension which maintains efficient total closure of the container when not in use and substantial sealing force is applied to prevent contamination of the contents of the container or loss of liquid from the container.

A gap or reduced width portion is provided in the rib 12, preferably at the horizontal portion 12*c*, as described hereinafter with reference to a second embodiment of the invention. This gap occurs at each side for receiving a respective lug 13 during fitting of the cap.

One particular use of the container of FIGS. 1 to 8 is for storing material in the form of sheets which are to be dispensed when desired through the aligned apertures 14 and 15; the container however can readily be closed to prevent contamination of the contents and also to retain any fluid which may be a volatile liquid provided within the container for wetting the sheets. The fluid could be an antiseptic or a cleaning solvent and the sheet material of a cellulosic nature. It will be appreciated that the closed container is a neat and smooth package which can readily be transported and stored as well as having an attractive appearance. Furthermore, a simple opening covered by a snap fitting cap which might inadvertently be knocked off has been avoided and the container can be economically manufactured and assembled.

The sheet material could be in the form of a roll or in the form of a pack of interleaved separate sheets. Particularly where a roll of detachable but interconnected sheets is used, a more prefered embodiment of the invention is that illustrated in FIGS. 9 to 17 in which parts which are substantially the same as corresponding parts in the embodiment of FIGS. 1 to 8 have been given like reference numerals. Only the distinctions between the two embodiments will be now described.

In the embodiment of FIGS. 9 to 17, the frusto conical side wall portion 10*a* of the base terminates below the top of the cap 11 and thus does not have the parallel sided top wall section illustrated in the embodiment of FIGS. 1 to 8.

Instead of the oval shaped aperture 15 in the base 10, the embodiment of FIGS. 9 to 17 has a keyhole shaped aperture 15*a* comprising a circular top opening 15*b*, a depending narrow slit 15*c* and a small circular opening 15*d* at the bottom of the slit 15*c*. A portion of the wall in the frusto conical side wall portion 10*a* has an oval shaped depression 16 extending around the base and arranged for alignment with the oval shaped aperture 14 in the cap; it is only the bottom portion of the slit 15*c* and the small circular opening 15*d* which intersect the depression 16 and therefore align with the opening 14 in the cap when the parts are in the open position.

The cap and base are interengaged in the same manner as the first embodiment with a lug 13 on the cap engaging under an inclined rib 12 on the base.

This embodiment can best be used for dispensing sheets for wiping purposes from a roll of interconnected sheets. Before initial use, the first sheet is fed by hand through the large circular aperture 15*b* so that the sheet can then be slid down the slot 15*c* so the sheet is compressed and fed substantially through the bottom portion of the slot and the small circular opening 15*d*. The cap can then be fitted onto the base and the leading end of the sheet will be accommodated in the depression 16*b*. In the closed position the interior of the frusto conical wall 11*a* of the cap contacts and engages firmly the frusto conical wall 10*a* of the base and thus seals the container essentially around the recess 16*b* and around the circular opening 15*b* and slot 15*c* thereby preventing the sheet working its way back up the slot 15*c*.

It is a simple matter to rotate the cap to the open position thereby aligning the aperture 14 in the cap with the central portion of the depression 16 to permit the leading sheet to be pulled out of the container and detached leaving just the leading end of the next sheet.

The second embodiment of the invention has particular advantage over the first embodiment of the invention when the entry of material such as micro-organisms is to be prevented as much as is practical and this second embodiment is also particularly useful where a volatile moistening liquid is contained inside the container.

Figure 17:
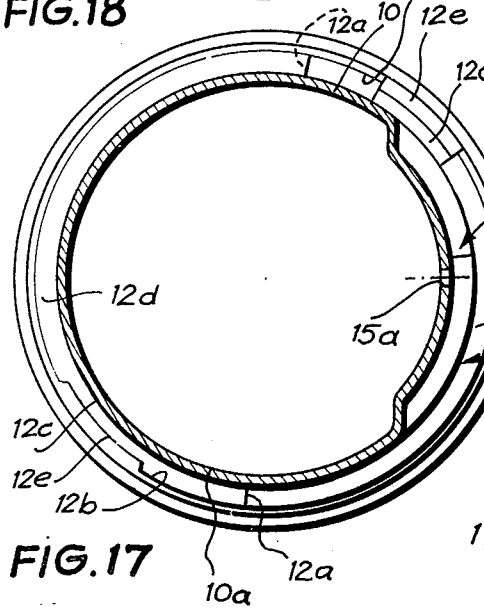
FIG. 17 is a section taken along the line XVII—XVII of FIG. 13.

Referring now to FIG. 17, the cross-section plan view of the base 10 illustrates more particulars of the rib 12. This configuration is also provided in the first embodiment of FIGS. 1 to 8.

On opposite sides of the base 10, the rib has a similar form respectively for engaging each of the lugs 13 on opposite sides of the cap 11. Each horizontal portion 12*c* of the rib is recessed on the outside edge thereof to provide a gap 12*e* for accommodating the respective lug 13 when the cap is press fitted so that the lug 13 snaps over the rib easily to engage below the rib 12 for retaining the cap in position of the base. In this position the minimum axially directed force is applied for urging the frusto conical surface into engagement with one another. The fully open position is established by slight rotation of the cap in an anti-clockwise direction relative to the base to move the lug 13 under the first ramp portion 12*b* whereby the edge of the lug engages against the shoulder 12*a*.

Figure 20:
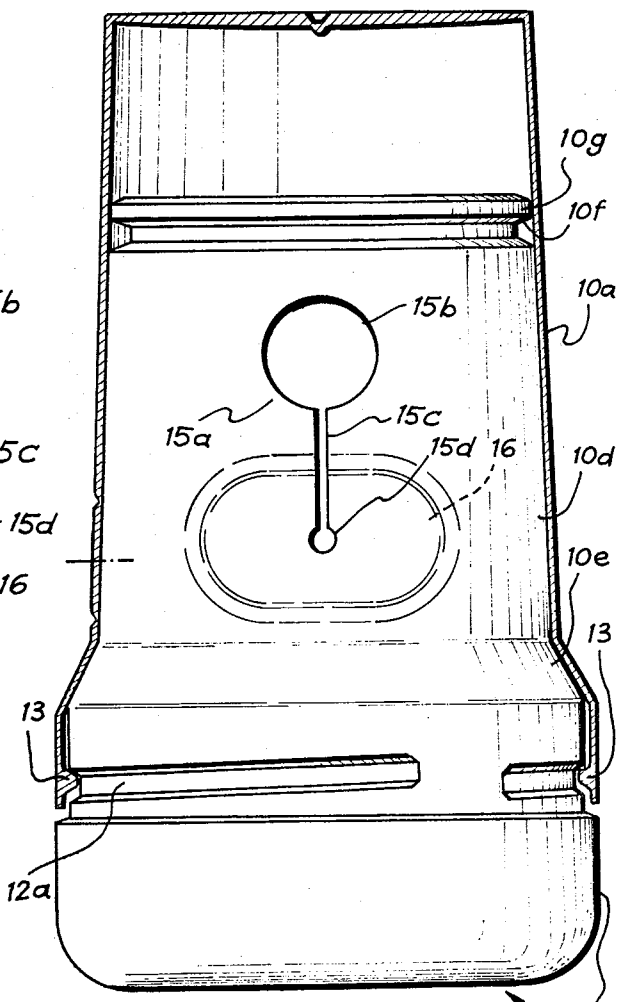
FIG. 20 is an axial cross-section of the container of FIG. 19.
Figure 19:
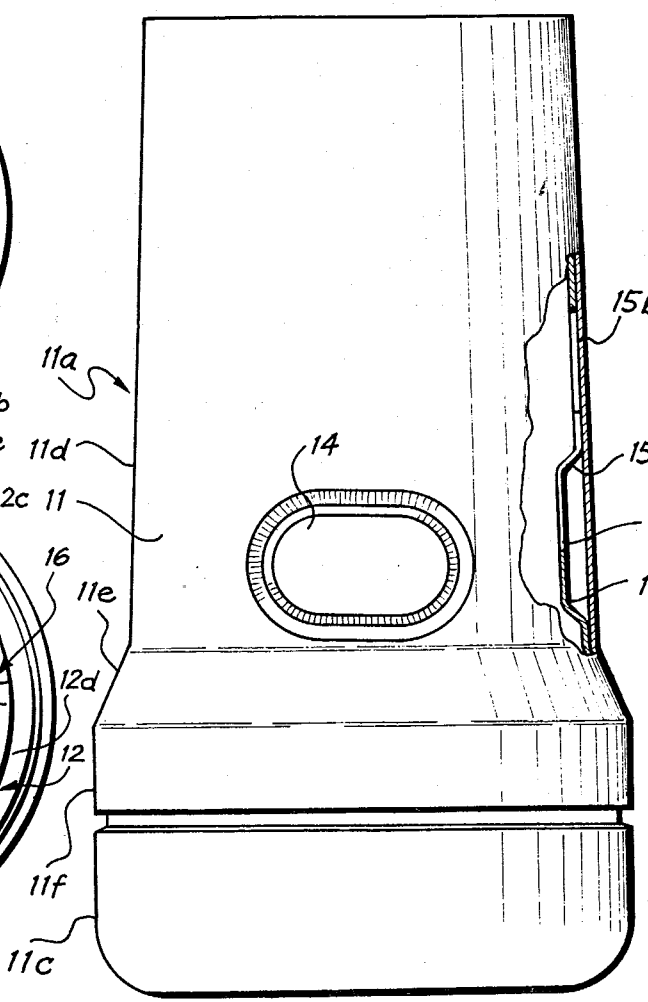
FIG. 19 is a front elevation, partly broken away of the third embodiment.
Figure 18:
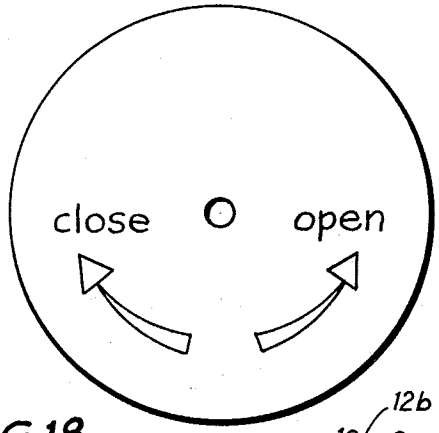
FIG. 18 is a view of the top of a container which is a third embodiment of the invention.

Upon rotation of the cap in a clockkwise direction, the lug runs smoothly along the lower surface of the rib past the horizontal portion 12*c* to move down the inclined ramp surface on the bottom of the second ramp portion 12*d* of the rib. Rotation through an angle of 105° brings the cap to the fully closed position. If desired a second abutment shoulder could be provided on the bottom of the rib 12 to limit the motion of the lug to define precisely the fully closed position. The embodiment of FIGS. 18 to 20 is similar to the second embodiment but has the distinction that the bottom portion of the base 10 is a parallel sided portion 10*c* and the frusto conical wall portion 10*a* is provided by an upper conical part 10*d* of shallow cone angle and a short lower conical part 10*e* of greater cone angle. Furthermore, the base 10*a*, in place of thin rib 12 of the first two embodiments has a helical groove 12*a*, the upper side wall of which provides the shoulder under which the lugs 13 of the cap engage. At the top of the base 10, a groove 10*f* is provided, the base terminating with an external flange 10*g*.

The cap 11 is shown in FIG. 19 and corresponds in shape to the base 10 in having an upper conical wall portion 11*d* of shallow angle, a short frusto conical wall portion 11*e* of steeper angle and a parallel sided end portion 11*f*.

This third embodiment can provide even better sealing of the contents when in the closed position.

What is claimed is:

1. In a container for storing and for dispensing sheet material, the container comprising:

(a) a hollow base;

(b) a cap adapted to fit over the hollow base to form a closed container;

(c) an aperture in the hollow base and an aperture in the cap through which when the container is in an open position sheet material may be extracted from the container; the improvement comprising:

(d) the hollow base comprising an end wall and a side wall, the exterior of which includes a frusto conical portion;

(e) the cap being a hollow cap having an end wall and a side wall, the interior of which includes a frusto conical portion corresponding to the frusto conical portion of the hollow base and the hollow cap being shaped for fitting over the hollow base with the frusto conical portion of the cap side wall coming into engagement with the frusto conical portion of the hollow base side wall when the cap and base are in an assembled position;

(f) the cap and the base having respective interengageable retention means for retaining the cap on the base when in an assembled position, the cap being rotatable relative to the base about the common axis of said frusto conical portions between a dispensing position and a closed position;

(g) the apertures in said cap and said base being in said respective frusto conical portions, with the aperture in said base being smaller than the aperture in said cap, the aperture in the cap aligning with the aperture in the base when the cap is in said dispensing position and the aperture in the cap being out of alignment with the aperture in the base when the cap is in said closed position, the side wall of the hollow base around the smaller aperture therein being in the form of a depression whereby on assembly of the container a recess is defined between the walls of the depression and the overlying frusto conical side wall portion of the cap when the cap is in the closed position, said hollow base further comprising a secondary aperture of a diameter larger than said smaller aperture in a portion of the frusto conical side wall thereof which does not come into alignment with the aperture in the hollow cap in any rotatable position of the assembled container, and a slot interconnecting said secondary aperture and said smaller aperture; and (h) when the cap is in said closed position surface contact is established between said frusto conical portions of the cap and base for substantially sealing the container.

* * * * *